US006755473B2

(12) United States Patent
Reed et al.

(10) Patent No.: US 6,755,473 B2
(45) Date of Patent: Jun. 29, 2004

(54) FLUID CONTROL SYSTEM FOR AN OFFICE FURNITURE DEVICE

(75) Inventors: Stewart D. Reed, Holland, MI (US); James M. Schaddelee, Holland, MI (US); George A. Miles, West Olive, MI (US); Steven B. Panse, Holland, MI (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 09/990,579

(22) Filed: Nov. 21, 2001

(65) Prior Publication Data

US 2002/0105218 A1 Aug. 8, 2002

Related U.S. Application Data

(60) Provisional application No. 60/252,852, filed on Nov. 22, 2000.

(51) Int. Cl.[7] ..... A47C 7/54

(52) U.S. Cl. ..... 297/411.36; 297/344.19

(58) Field of Search ..... 297/411.36, 344.19; 248/162.1, 631, 560; 108/147, 141, 144.11

(56) References Cited

U.S. PATENT DOCUMENTS

| | | | | | |
|---|---|---|---|---|---|
| 2,522,246 | A | | 9/1950 | Armstrong | |
| 3,024,067 | A | | 3/1962 | Brandoli | |
| 4,101,005 | A | * | 7/1978 | Fewkes | 187/275 |
| 4,111,389 | A | * | 9/1978 | Gundlach et al. | 248/162.1 |
| 4,145,957 | A | * | 3/1979 | McClocklin | 91/508 |
| 4,161,136 | A | * | 7/1979 | Krieger | 91/461 |
| 4,373,334 | A | * | 2/1983 | Carlander | 60/594 |
| 4,374,497 | A | * | 2/1983 | Harmand | 108/4 |
| 4,406,123 | A | * | 9/1983 | Matsui et al. | 60/459 |
| 4,527,829 | A | * | 7/1985 | Fanslau et al. | 297/17 |
| 4,592,590 | A | * | 6/1986 | Slaats et al. | 297/344.19 |
| 4,593,951 | A | * | 6/1986 | Slaats et al. | 297/344.19 |
| 4,709,962 | A | | 12/1987 | Steinmann | |
| 4,711,486 | A | | 12/1987 | Fujiyama | |
| 4,748,896 | A | * | 6/1988 | Ott et al. | 91/448 |
| 4,872,727 | A | | 10/1989 | Rye | |
| 4,957,102 | A | | 9/1990 | Tan et al. | |
| 5,069,496 | A | | 12/1991 | Kunh et al. | |
| 5,251,958 | A | | 10/1993 | Roericht et al. | |

(List continued on next page.)

*Primary Examiner*—Peter M. Cuomo
*Assistant Examiner*—Stephanie N. Harris
(74) *Attorney, Agent, or Firm*—Brinks Hofer Gilson & Lione

(57) ABSTRACT

A chair, or other office furniture device, includes a first and second support member. The first support member has a longitudinal extent and a fluid passageway formed within at least a portion thereof. A first piston, having a first and second end, is moveably disposed in the fluid passageway. The second support member is coupled to the first end of the first piston. A fluid supply is disposed in the fluid passageway and communicates with the second end of the first piston. A pressure is applied to the fluid supply. A fluid flow controller controls a flow of the fluid supply and is operable between at least an open and closed position, wherein the fluid supply is allowed to flow when the controller is in the open position and wherein the fluid supply is not allowed to flow when the controller is in the closed position. In one preferred embodiment, the fluid supply comprises a magneto-rheological fluid, and the controller comprises a magnet moveable between at least a first and second position, wherein the magnet applies a magnetic field to the fluid supply when in the first position. In an alternative preferred embodiment, the fluid supply comprises a hydraulic fluid, and the controller comprises a valve moveable to an open position to allow the fluid supply to flow between the first and second positions. A method for moving a chair component is provided, along with a method for moving a support member on an office furniture device.

52 Claims, 5 Drawing Sheets

U.S. PATENT DOCUMENTS 5,277,281 A * 1/1994 Carlson et al. ..... 188/267
5,320,308 A 6/1994 Bilezikjian et al.
5,366,274 A 11/1994 Roericht et al.
5,398,917 A 3/1995 Carlson et al.
5,452,868 A 9/1995 Kanigowski
5,452,957 A 9/1995 Duggan
5,487,590 A 1/1996 Haynes
5,549,837 A 8/1996 Ginder et al.
5,573,088 A 11/1996 Daniels
5,577,803 A * 11/1996 Guilbaud ..... 297/314
5,652,704 A 7/1997 Catanzarite
5,658,050 A 8/1997 Lorbiecki
5,690,185 A * 11/1997 Sengel ..... 180/65.1
5,693,004 A 12/1997 Carlson et al.
5,765,817 A 6/1998 Breitbach
5,829,319 A 11/1998 Mokeddem
5,842,547 A 12/1998 Carlson et al.
5,871,257 A * 2/1999 Dundes, Sr. ..... 297/314
5,908,221 A * 6/1999 Neil ..... 297/411.36
5,915,513 A 6/1999 Isley, Jr. et al.
RE36,270 E 8/1999 Duggan
5,956,951 A * 9/1999 O'Callaghan ..... 60/326
5,967,273 A 10/1999 Hampton
5,984,056 A 11/1999 Agnihotri et al.
5,984,385 A 11/1999 Shtarkman et al.
5,993,358 A 11/1999 Gureghian et al.
6,009,982 A 1/2000 Agnihotri et al.
6,019,201 A * 2/2000 Gordaninejad et al. .. 188/267.1
6,030,544 A 2/2000 Yokota et al.
6,032,772 A 3/2000 Moser et al.
6,047,797 A 4/2000 Popjoy
6,050,380 A 4/2000 Peinemann et al.
6,182,583 B1 * 2/2001 Larson ..... 108/147
6,276,756 B1 * 8/2001 Cho et al. ..... 297/344.19
6,279,416 B1 * 8/2001 Bucholtz et al. ..... 74/501.5 H
6,439,662 B2 * 8/2002 Ma ..... 297/344.19
6,474,619 B1 * 11/2002 Ma ..... 248/631
6,536,357 B1 * 3/2003 Hiestand ..... 108/95

* cited by examiner

FLUID CONTROL SYSTEM FOR AN OFFICE FURNITURE DEVICE

This application claims the benefit of U.S. Provisional Patent Application No. 60/252,852, filed Nov. 22, 2000, the entire disclosure of which is hereby incorporated herein by reference.

BACKGROUND

The present invention relates generally to a fluid control system, and in particular, to a fluid control system for various office furniture devices, including various chair components.

Typically, various office furniture devices, including for example, chairs and worksurface members, are configured with moveable support members. For example, office chairs generally can be configured with moveable support arms, support columns, backrests and seats. Likewise, worksurface members or assemblies often are configured with moveable support legs and the like.

Often, the movement of such support members is controlled with mechanical systems, including for example various ratchet mechanisms, gear trains and the like. Typically, support members controlled by such devices have some play in them due to the tolerance buildup between the interconnected parts, such that the support members, or components connected thereto, may feel loose to the user. Moreover, many such devices have a limited number of adjustable positions, and therefore are not infinitely adjustable. In addition, such systems are passive, meaning that they typically require the user to move the support member, or component supported thereon, between one or more positions. Alternatively, when electromechanical devices, including for example various screw devices, are used, a power source, which can be expensive and bulky, must be provided.

Alternatively, the movement of the various support members or components can be controlled with various pneumatic or gas spring devices. Although such systems are active, meaning that they typically are capable of moving the support member or component in at least one direction without the assistance of the user, they generally exert large amounts of pressure, which must be countered by the user to move the support member or component in the opposite direction. Moreover, such devices typically move rather quickly and the adjustment thereof can feel erratic to the user.

In other alternatives, the movement is controlled with various hydraulic devices. Often, office furniture devices employing hydraulic devices are relatively heavy, and may require various power sources for pumps and the like, both of which limit the portability of the devices. In addition, such devices often include numerous lines, seals and other parts, which can significantly add to the cost of the device and which may require frequent, periodic maintenance.

SUMMARY

Briefly stated, in one aspect of the invention, a chair includes a first and second support member. The first support member has a fluid passageway formed within at least a portion thereof. A first piston, having a first and second end, is moveably disposed in the fluid passageway. The second support member is coupled to the first end of the first piston. A fluid supply is disposed in the fluid passageway and communicates with the second end of the first piston. A second piston has a first end and a second end, wherein the second end communicates with the fluid supply. A force applying element biases the first end of the second piston. A fluid flow controller controls a flow of the fluid supply and is operable between at least an open and closed position, wherein the fluid supply is allowed to flow between the first and second pistons when the controller is in the open position and wherein the fluid supply is not allowed to flow between the first and second pistons when the controller is in the closed position.

In one preferred embodiment, the fluid supply comprises a magneto-rheological fluid, and the controller comprises a magnet. The magnet is moveable between a first and second position, wherein the magnet applies a magnetic field to the fluid supply when in the first position.

In an alternative preferred embodiment, the fluid supply comprises a hydraulic fluid, and the controller comprises a valve. The valve is moveable to an open position to allow the fluid supply to flow between the first and second positions.

In a preferred embodiment, the support member comprises a one-piece member having an interior surface defining the fluid passageway. Also in a preferred embodiment, a second fluid passageway is formed in the support member, and the second piston member is slidably disposed in the second fluid passageway.

Preferably, one of the support members comprises a chair component. For example, in one embodiment, the second support member comprises an armrest member.

In another aspect of the invention, an office furniture device comprises a support member having a fluid passageway formed within at least a portion thereof and a piston slideably disposed in said fluid passageway and having a first and second end. A magneto-rheological fluid is disposed in the fluid passageway and communicates with the second end of the piston. A magnet is moveable between at least a first and second position, wherein the magnet applies a magnetic field to said magneto-rheological fluid when in said first position. An actuator is connected to said magnet and is operable between at least a first and second position, wherein the actuator moves the magnet to the first position when the actuator is in the first position and wherein the actuator moves the magnet to the second position when the actuator is in the second position.

In other aspects of the invention, a method for operating a chair is provided, along with a method for operating an office furniture device.

The present inventions provide significant advantages over other office furniture devices and their respective control systems. For example, by providing a support member having a fluid passageway formed therein, the system can be greatly simplified. Moreover, in a preferred embodiment, wherein the fluid passageway and controller, or control system, are locally contained within or adjacent the support member, various extraneous parts, such as conduit lines, are avoided, thereby reducing the cost of the device and the expense of maintaining it. Moreover, by using a simple force applying member, the additional cost and weight associated with using various pumps and electromechanical devices is avoided, thereby making the office furniture component portable. In addition, such a mechanical system avoids any interference with electrical devices such as computers. At the same time, the use of a fluid control system, with a controller, provides infinite adjustment of the device and a rigid feel when in the closed position.

The use of a magneto-rheological fluid, together with a moveable magnet, also provides significant advantages. For example, the simple movement of the magnet between the first and second positions can be used to apply a magnetic field to the magneto-rheological fluid, which provides a very rigid feel to the device. In this way, the use of various electrical circuits to create the magnetic field is avoided, which in turn simplifies the device and eliminates the need for a power source, which can interfere with the operation of various office equipment, such as computers.

The present invention, together with further objects and advantages, will be best understood by reference to the following detailed description taken in conjunction with the accompanying drawings.

DETAILED DESCRIPTION OF THE PRESENTLY PREFERRED EMBODIMENTS

Figure 1:
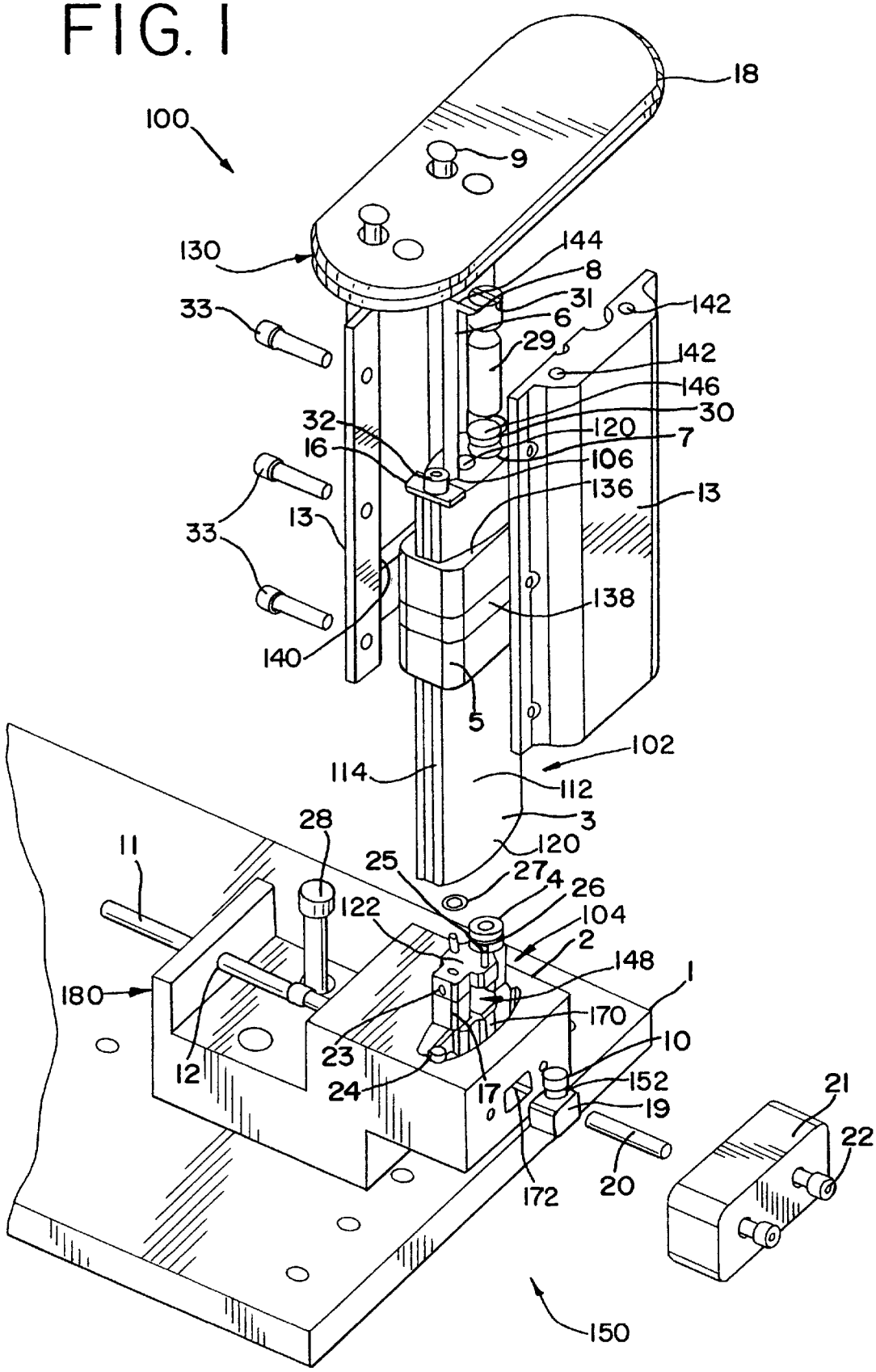
FIG. 1 is an exploded perspective view of one embodiment of an armrest assembly for a chair.

Referring to FIG. 1, an armrest assembly 100 is shown as including a first and second longitudinally and vertically extending support member 102, 130. The term "longitudinal" means of or relating to length or the lengthwise direction. The first, or inner, support member includes a riser 3 and a base member 104. The riser 3 is preferably an aluminum extrusion having a first and second fluid passageway 106, 108 formed therethrough. The first and second fluid passageways 106, 108 are preferably formed in the riser along parallel paths, and are preferably cylindrical, although they may be configured with alternative cross-sectional areas. Preferably, the riser is a one-piece member having an interior surface defining the fluid passageways 106, 108, such that the interior surface is in direct contact with a fluid supply, thereby avoiding the use of liners, cylinders, etc. in the riser. Preferably, the diameter of the second fluid passageway 108 is about twice that of the first fluid passageway 106. In one embodiment, the diameters of the first and second fluid passageways are about 0.25 inches and 0.50 inches respectively. Preferably, the riser, with its fluid passageways, is extruded, although it should be understood that the passageways could be drilled or bored out. A recess 110 is formed on the bottom end of the first support member at the entryway to the first fluid passageway 106. The recess 110 is shaped to receive a seal member 4, e.g. an o-ring, which seals the interface between the riser 3 and the base member 104.

Figure 7:
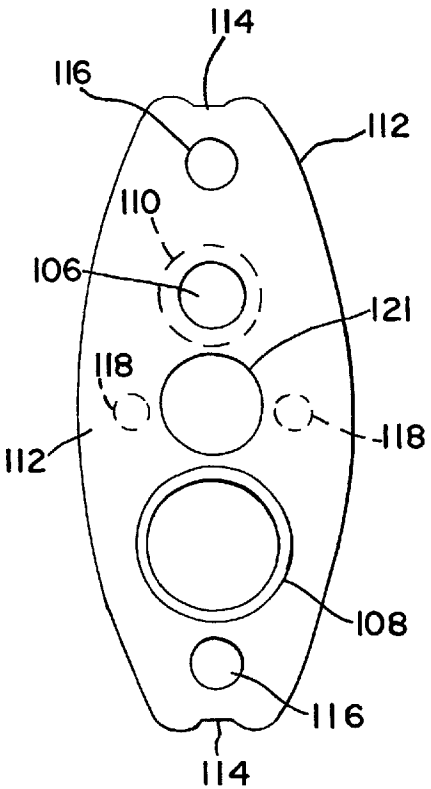
FIG. 7 is a top end view of a riser.

In the embodiment shown in FIGS. 1 and 7, the exterior profile of the riser is generally elliptically shaped, and is preferably configured with opposite convex outer side surfaces 112 and concave outer end surfaces 114, which form grooves along the end of the riser. After assembly, at least a portion of the riser is visible to the user. In this way, the riser provides an aesthetically pleasing structural support for the armrest, which is capable of handling significant structural loading due to its extruded profile, and which at the same time provides a passageway for various fluids.

A pair of openings 116 are formed in the top end of the riser and are generally aligned with the first and second fluid passageways 106, 108 along the elongated dimension of the riser. A pair of openings 118 also formed in the bottom end of the riser opposite a central opening 121 and are aligned along an axis lying substantially perpendicular to the elongated dimension. The central opening 121 can be used as an alternative fluid passageway having an alternative cross-sectional flow area.

Referring to FIGS. 1 and 4–6, the bottom end 120 of the riser abuts the top surface 122 of an upper portion 4 of the base member, which is preferably made of plastic. The upper portion 4 of the base member has a first opening 124 or passageway formed therein that is aligned and communicates with the first fluid passageway 106, with the seal member 27 forming a seal between the riser 3 and the base member. The upper portion 4 of the base member further includes a cylindrical boss member 126 extending upwardly from the upper surface of the upper portion. A seal member 26, preferably an o-ring, is disposed circumferentially around the boss member. The boss member, with its seal member, is inserted into the second fluid passageway 108 at the bottom end of the riser, such that the seal member 26 engages the interior surface of the fluid passageway and forms a seal therewith. An opening 128 or passageway formed in the boss member communicates with the second fluid passageway 108.

Figure 5:
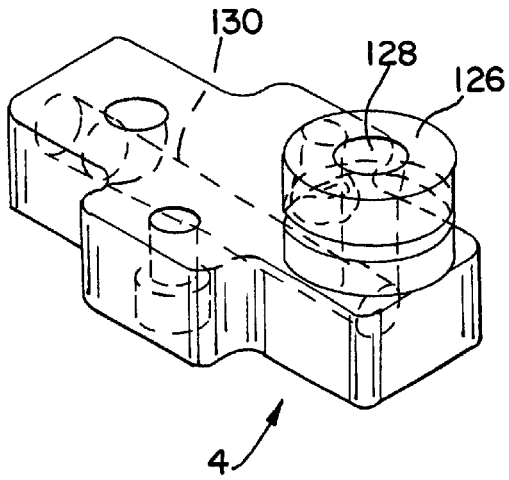
FIG. 5 is a perspective view of an upper portion of a base member with a fluid conduit formed therein.
Figure 6:
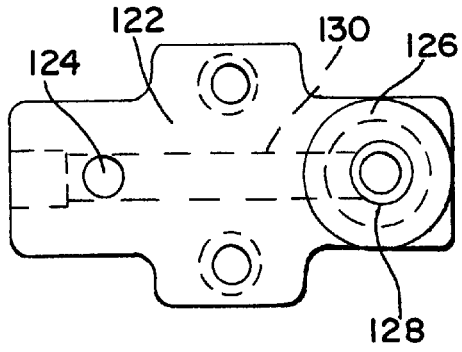
FIG. 6 is a top plan view of the base member shown in FIG. 5.
Figure 8:
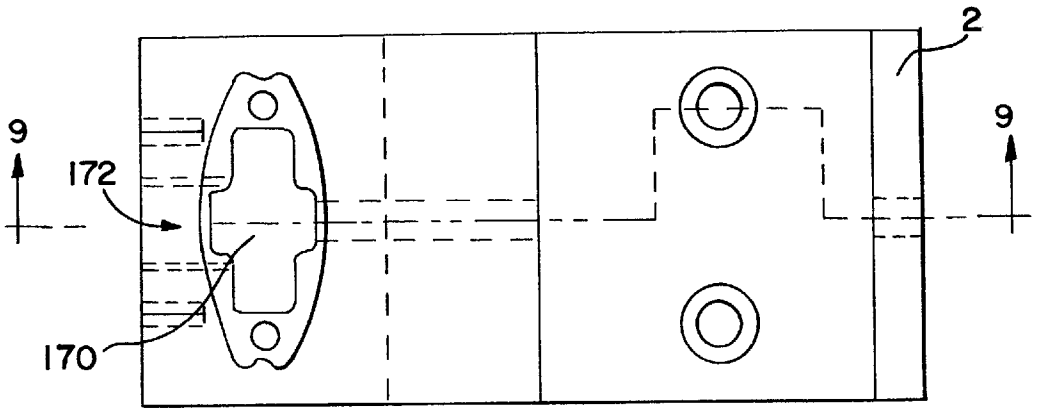
FIG. 8 is a top plan view of a housing.
Figure 9:
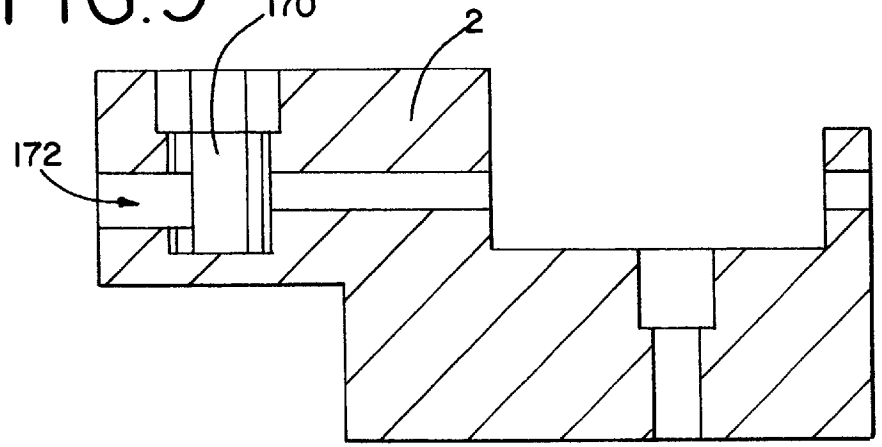
FIG. 9 is a cross-sectional view of the housing taken along line 9—9 in FIG. 8.

As shown in FIGS. 5 and 6, a fluid conduit 130 or passageway extends between and connects the passageways 124, 128 formed in the base member so as to form a continuous fluid passageway allowing the fluid supply to flow between the first and second fluid passageways 106, 108. An end of the conduit is plugged with plug 132 to prevent fluid from escaping the system. A pair of fasteners 134 are used to secure the base member to the riser 3 as they engage the openings 118, which are preferably threaded, formed in the bottom end of the riser. It should be understood that the base member forms part of the support member, and can be formed integrally with the riser as a single unit. In such an embodiment, the fluid passageway is simply formed as a continuous fluid passageway therein.

Referring to FIG. 1, the second support member includes a slide member 5 that is slideably disposed on the outside of the riser and has an interior opening 136 shaped to receive the riser, including rib portions that engage the grooves formed in the riser. The slide member includes a circumferential rib or raised portion 138 formed around a periphery thereof The slide member is preferably made of a material having a low coefficient of friction and high lubricity, such as Delrin. Other materials, including Ultra High Molecular Weight Polyethylenes (UHMWPE) or other viscous plastics would also work.

The second support member 130 further comprises a pair of outer cover members 13 and a top plate 18, which forms part of an armrest member. The cover members 13 are secured to one another on opposite sides of the riser 3 and slide member 5 with fasteners 33 and clamp the slide member therebetween. The cover members 13 form a recess 140 that is shaped to receive the raised portion 138 of the slide member 5 such that the cover members are secured to the slide member. The cover members are preferably made of aluminum, although other metals or plastics, such as abs also could be used. The top plate 18 is secured to the top of the cover members with fasteners 9 that threadably engage holes 142 formed in the ends of the covers. The top plate is preferably made of aluminum, although other metals or plastics, such as ABS also could be used. It should be understood that the cover members could be made as a single integral member that directly slideably engages the riser, or alternatively, that the cover members and the top plate can be integrally formed as a single member.

Referring to FIG. 1, a piston 6 is slideably disposed in the first fluid passageway 106 and includes a first end 144 and a second end 146, with the first end 144 extending from the top of the riser. The second end of the piston includes one or more seals, preferably o-rings, disposed thereabout and which sealably engage the interior surface of the fluid passageway. The first end 144 is secured to the cover members 13 of the second support member with a pin 8. It should be understood that the piston 6 could be secured to the second support member in alternative ways, such as by directly securing the piston to the plate member, or by forming the piston integrally with the second support member.

A second piston 30 is slideably disposed in the second fluid passageway 108 and includes a first end 146 and a second end. A seal member 7 is disposed around the piston and engages the interior surface of the fluid passageway 108. A spring 29 is inserted in the fluid passageway 108 on top of the second piston 30 and engages the first end 146 thereof A retainer member 31 is then secured to the riser in the end of the fluid passageway 108 to provide a backstop for the spring 29 as it biases the second piston 30 downwardly in the second fluid passageway 108.

A fluid supply is disposed in the continuous fluid passageway formed by the passageways 106, 108, 130. A stop 16 is secured to the top of the riser with a fastener 32. The stop 16 extends beyond the profile of the riser 3 and engages the top of the slide member 5 so as to limit the upward travel of the second support member relative to the first support member.

Figure 4:
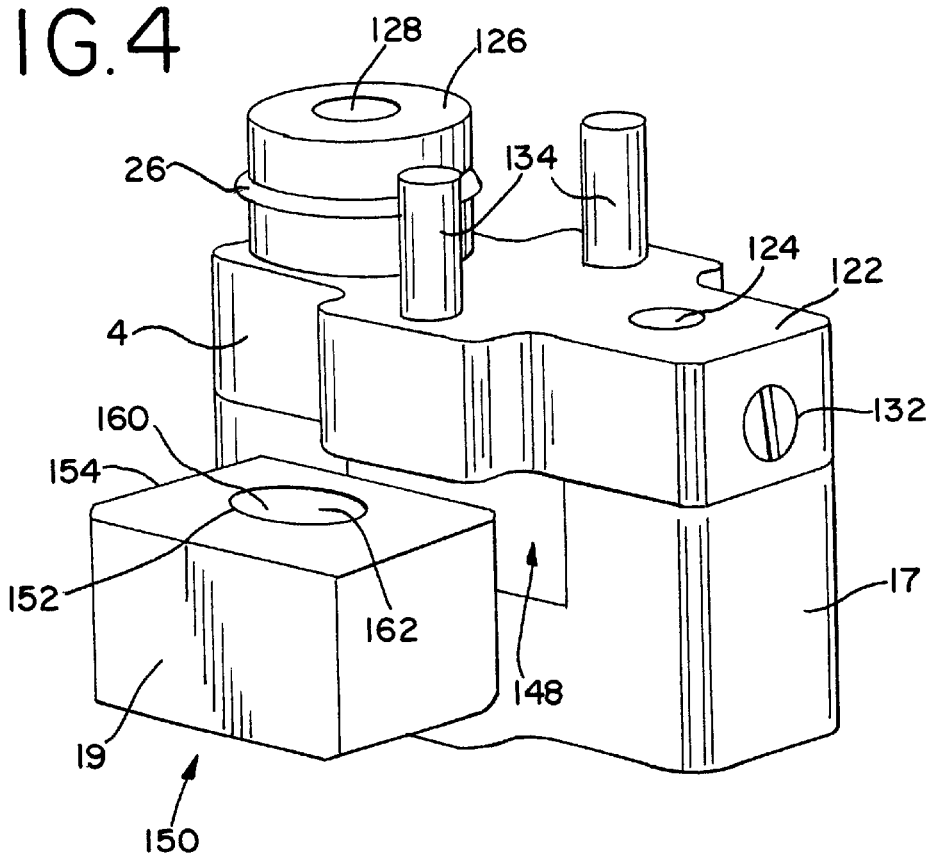
FIG. 4 is a perspective view of a control system assembly.

Referring to FIGS. 1 and 4, a fluid flow controller, or control system 150, is operable between at least an open and closed position, wherein the fluid supply is allowed to flow in the continuous fluid passageway 106, 108, 130. A lower portion 17 of the base member, which is preferably U-shaped, forms a passageway 148 or track in the base member between the upper and lower portions 17, 4. The lower portion is preferably made of a material having a low coefficient of friction and high lubricity, such as Delrin. Other materials, including Ultra High Molecular Weight Polyethylenes (UHMWPE) or other viscous plastics would also work.

In one preferred embodiment, the controller, or control system, includes a shuttle member 19 that is dimensioned to be moveably received in the passageway 148. The shuttle member 19 includes a bore 152 formed in the upper surface 154 thereof. A magnet 10, preferably cylindrical, is inserted into the bore, with a top surface 162 of the magnet lying substantially flush with the upper surface 154 of the shuttle member 19. The magnet 10 is preferably a Rare Earth magnet, which is a type of commercial permanent magnet.

Rare Earth magnets are composed of, for example, Samarium Cobalt (SmCo) and Neodymium Iron Boron (NdFeB). SmCo magnets are available in a number of different grades that span a wide range of properties and application requirements. Ferrite magnets, which are sintered permanent magnets composed of Barium or Strontium Ferrite, also can be used. Alnico materials, composed primarily of alloys of Aluminum, Nickel, and Cobalt also can be used. Typically, Alnico magnets are manufactured by way of either a casting or a sintering process. Cast magnets may be manufactured in complex shapes, e.g., horseshoe shapes, which may not be obtainable by other processes. Sintered Alnico magnets offer slightly lower magnetic properties, but better mechanical properties than cast Alnico magnets.

The shuttle member 19 and magnet 10 are moveable between at least a first and second position. In the first position, the shuttle 19 is disposed in the passageway 148 such that the magnet 10 lies directly under and adjacent to the fluid passageway. In this position, the magnet 10 applies a magnetic field to the fluid supply in the fluid passageway 130.

Preferably, in one embodiment, the fluid supply is a magneto-rheological fluid, which essentially is a suspension of micron-sized, magnetizable particles in oil. An exemplary magneto-rheological fluid is a Rheonetic™ Magnetic Fluid available from the Lord Corporation. When the magnet 10 is in the second position, such that it is moved out of the passageway 148 and does not thereby apply a magnetic field to the fluid supply in the fluid passageway 130, the magneto-rheological fluid is free-flowing with a consistency similar to motor oil or hydraulic fluid. Exposure to the magnetic field, which occurs as the shuttle is moved to the first position, however, transforms the fluid into a near-solid in milliseconds, thereby effecting a very large change in viscosity. The change in the viscosity of the fluid is proportional to the magnitude of the applied magnetic field. By applying the magnetic field, the fluid in essence is solidified in the fluid passageway 130 and thereby locks the first and second piston in place, as the fluid supply is prevented from flowing between the first and second fluid passageways 106, 108.

Referring to FIG. 1, a housing 2 includes a cavity 170 shaped to receive a bottom end of the riser and the base member 104, which is secured to the housing 2. The housing 2 further includes a passageway 172 aligned with the passageway 148 formed in the base member, such that the shuttle can be moved to a second position out of the base member passageway 148 and into the housing passageway 172. In this way, the housing 2 and base member 104, with their perspective passageways 148, 172, form a track for the shuttle. Although the movement of the shuttle and magnet corresponds to a translation of the shuttle and magnet along a linear path, it should be understood that those members could also be rotated or pivoted between an open and closed position.

The controller, or control system, further includes an actuator 180 that effects the movement of the magnet and shuttle. The actuator includes a push rod 11 that is attached to one side of the shuttle. On the opposite side of the shuttle, a spring 20 is disposed between the shuttle 19 and an end wall 21 or retainer attached to or formed on the housing 2. For example, fasteners 22 can be used to secure the end wall 21. The spring 20 acts in opposition, either in compression or tension, to the movement of the push rod, so as to bias the shuttle into either a normally open or closed position. It should be understood that the push rod 11 can be actuated by the user to move the shuttle 19 to the open or closed position, and that the push rod can be further operably linked or coupled to other levers, buttons, etc. (not shown), which can be located at a remote location and which are accessible to the user. The housing can be secured to other supporting structure 1 with fasteners 28, or can be integrally formed therewith.

It should be understood that an electromagnet, such as a solenoid or a coil that is electrified, can also be used to apply a magnetic field to the fluid supply. In such a system, a power supply is required to energize the device and to thereby form the magnetic field.

In operation, the user moves the push rod 11 to move the magnet 10 into the closed position adjacent the fluid supply, or energizes the electromagnet, so as to create a magnetic field and thereby magnetize the magneto-rheological fluid. In this position, the armrest and in particular the second support member 130, is locked in position. When the user desires to adjust the height of the armrest, the actuator 180 is manipulated to move the push rod 11 and the connected magnet 10 to the open position. In this position, the fluid is substantially isolated from the influence of the magnetic field, such that the viscosity of the fluid allows it to flow in the fluid passageway. To raise the armrest, the user simply allows the spring 29 to act on and bias downwardly the second piston 30, which displaces the fluid supply from the second fluid passageway 108 to the first fluid passageway 106 and thereby acts on or raises the first piston 6 and attached support member. To lower the armrest, the user simply applies a force to the support member 130, and the armrest member 18 in particular, which lowers the first piston 6 in the first fluid passageway 106 and displaces the fluid supply, which acts on or raises the second piston 30 against the biasing force of the spring 29.

It should be understood that instead of using a spring as a force applying member, a positive pressure could be applied to the first end 146 of the second piston 30, such as by a pump or other device. In addition, it should be understood that the first and second fluid passageways do not need to be made parallel, or even as separate passageways. For example, a single linear passageway could be configured with pistons disposed in opposite ends thereof and with a control system regulating the flow of fluid therebetween. It should also be understood that the position of the fluid passageways, control system and pistons could be reversed, with the fluid passageways and control system formed in a moveable second support member, and with the piston connected to the first support member, which is preferably stationary. Finally, it should be understood that in an alternative embodiment, the second piston can be eliminated in its entirety, wherein a positive pressure is applied directly to the fluid supply, which acts on the first piston 6.

Figure 2:
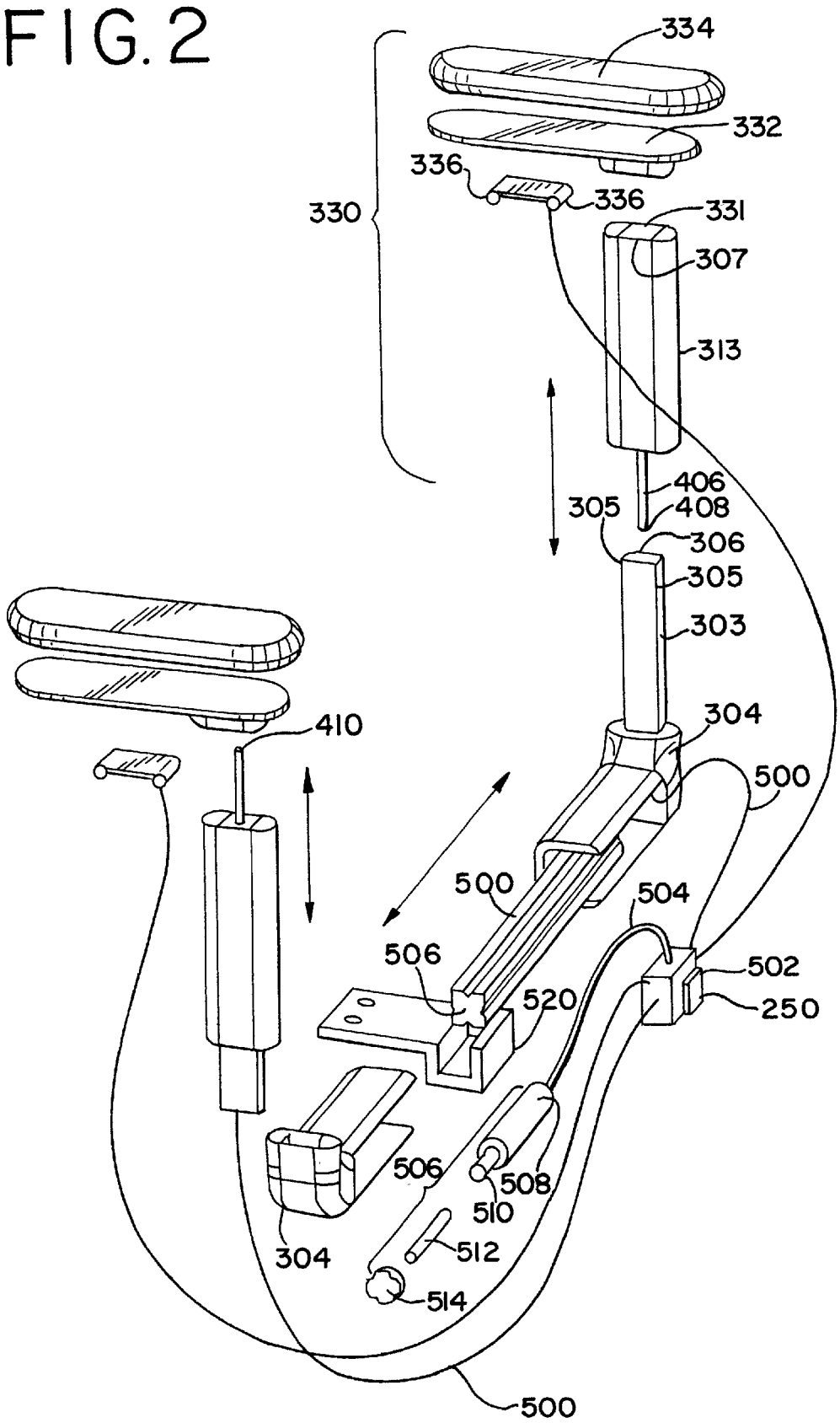
FIG. 2 is an exploded perspective view of an alternative embodiment of an armrest assembly for a chair.
Figure 3:
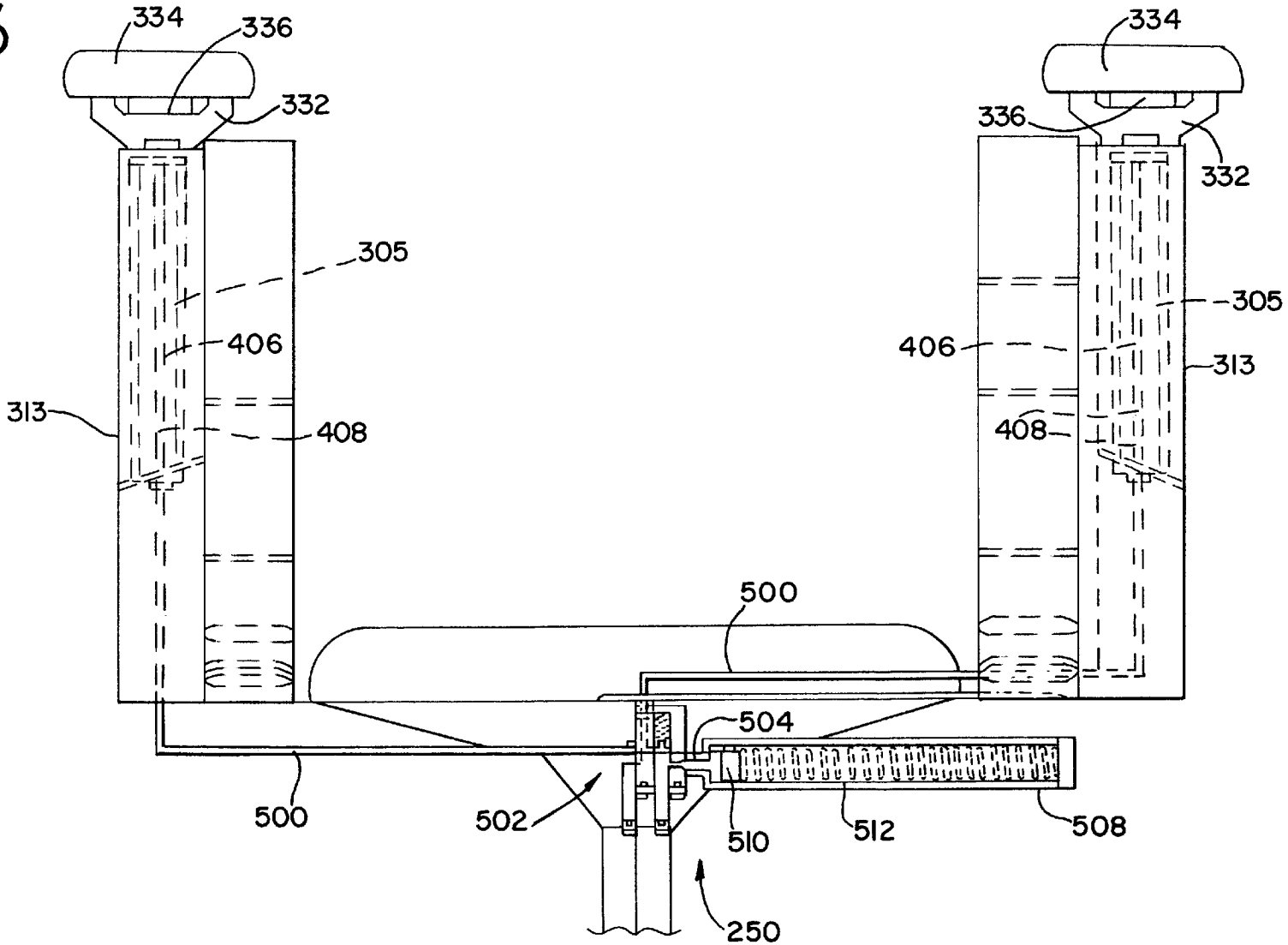
FIG. 3 is a front schematic view of the armrest assembly shown in FIG. 2.

Referring to FIGS. 2 and 3, an alternative embodiment of an armrest assembly is shown. In this embodiment, the riser 303 is secured to a laterally extending base member 304. The second support member 330 includes an outer slide member having an opening 331 formed therethrough, which is shaped to mate with the exterior contour of the riser, and an armrest member 332. The slide member 313 includes opposite rib portions 307 that engage grooves formed along the sides of the riser 303. The armrest member 332 includes a top plate 318 that is secured to the slide member and a pad 334 secured to the top plate. An actuator lever 336 is pivotally connected to the armrest member 332.

In this embodiment, the riser 303 includes a single fluid passageway 306 formed therethrough. A piston 406 is inserted in the passageway 306, and includes a pair of seal members 408 that engage the interior surface of the passageway. A top end 410 of the piston 406 is connected to the second support member 330. A conduit member 500 is connected to the bottom of the riser and communicates with the fluid passageway 106. The conduit member 500 is connected to a valve 502, which forms part of a fluid controller, or control system 250. A second conduit member 504 is connected to and communicates with a piston assembly 506, which includes a cylinder housing 508 and a piston 510 disposed therein. A spring 512 is disposed between the end 514 of the housing and the piston 510 and biases the piston 510 within the housing 508. A fluid supply flows between the pistons 510, 410 in the conduits 504 and fluid passageway 306.

In operation, the actuator lever 336 is pivoted to operate the valve 502 between at least an open and closed position. In the open position, fluid, preferably hydraulic fluid, is allowed to flow between the pistons 510, 410. To raise the armrest member 330, the spring 512 biases the piston 510, which displaces the fluid and thereby raises the piston 410 in the riser 313. To lower the armrest member, the user pushes on the armrest 330 to displace the fluid in the passageway and which thereby moves the piston 510 against the force of the spring 512. The valve 502 can be actuated by moving the lever 336, which is operably connected thereto. It should be understood that a single piston assembly 506 and valve 502 can be operably connected to a pair of armrests, or to other members, as shown in FIG. 2, or that individual piston assemblies and valves can be separately connected to each component.

It should be understood that the controller, or control system shown in FIG. 2, which includes a simple valve, could also be used in the first embodiment. Conversely, the magnet and magneto-rheological fluid controller shown in the first embodiment could be used in the embodiment shown in FIG. 2 in place of the valve and hydraulic fluid.

In another aspect of the embodiment shown in FIG. 2, the laterally extending base member 304, which defines a support member, is slideably disposed on a longitudinally and horizontally extending support member 500, configured with a fluid passageway 506. The support member 500 is supported on a supporting structure 520. It should be understood that the base members 304 can be connected to pistons (not shown) disposed in the fluid passageway 506 formed in the support member 500, the lateral movement of which is controlled by the various control systems herein described so as to provide laterally adjustable armrests.

Although the aforedescribed embodiments have been directed to vertically and laterally adjustable armrests, it should be understood that the fluid control system, including the fluid passageway(s), the piston and the control system, could also be used to adjustably control other chair components or support members, including for example the height and depth of a seat and the height of a backrest. In addition, the fluid control system can be used to control the relative movement between other office furniture support members, including for example upper and lower support members forming a support leg for a work surface.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. An office furniture device comprising:

a first and second support member, said first support member having a fluid passageway formed within at least a portion thereof;

a first piston moveably disposed in said fluid passageway, said first piston having a first and second end, wherein said second support member is coupled to said first end of said first piston;

a fluid supply disposed in said fluid passageway and communicating with said second end of said first piston;

a second piston having a first end and a second end, wherein said second end communicates with said fluid supply;

a force applying element biasing said first end of said second piston; and a fluid flow controller controlling a flow of said fluid supply at a location between said first and second pistons, wherein said controller is operable between at least an open and closed position, wherein said fluid supply is allowed to flow between said first and second pistons when said controller is in the open position and wherein said fluid supply is prevented from flowing between said first and second pistons when said controller is in the closed position.

2. The invention of claim 1 wherein said fluid supply comprises a magneto-rheological fluid.

3. The invention of claim 1 wherein said fluid supply comprises a hydraulic fluid.

4. The invention of claim 1 wherein said controller comprises a valve.

5. The invention of claim 1 wherein said fluid passageway is a first fluid passageway and wherein said first support member further comprises a second fluid passageway, wherein said second piston is movably disposed in said second fluid passageway.

6. The invention of claim 1 wherein said first support member comprises a one piece member having an interior surface defining said fluid passageway.

7. The invention of claim 1 wherein said force applying element comprises a mechanical spring.

8. The invention of claim 1 wherein said force applying element comprises a positive pressure.

9. The invention of claim 1 wherein substantially the same volume of supply fluid is maintained in said fluid passageway between said first and second pistons as said fluid supply is allowed to flow between said first and second pistons when said controller is in the open position, wherein said fluid supply, which is displaced by the movement of one of said first and second pistons, moves the other of said first and second pistons.

10. The invention of claim 1 wherein said second support member comprises a chair component.

11. The invention of claim 10 wherein said chair component is integrally formed with said second support member.

12. An office furniture device comprising:

a first and second support member, said first support member having a fluid passageway formed within at least a portion thereof;

a first piston moveably disposed in said fluid passageway, said first piston having a first and second end, wherein said second support member is coupled to said first end of said first piston;

a fluid supply disposed in said fluid passageway and communicating with said second end of said first piston, said fluid supply comprising a magneto-rheological fluid;

a second piston having a first end and a second end, wherein said second end communicates with said fluid supply;

a force applying element biasing said first end of said second piston; and a fluid flow controller controlling a flow of said fluid supply at a location between said first and second pistons, wherein said controller is operable between at least an open and closed position, wherein said fluid supply is allowed to flow between said first and second pistons when said controller is in the open position and wherein said fluid supply is prevented from flowing between said first and second pistons when said controller is in the closed position, and wherein said controller comprises a magnet moveable between at least a first and second position corresponding to said open and closed positions respectively, wherein said magnet applies a magnetic field to said fluid supply when in said first position.

13. The invention of claim 12 further comprising an actuator connected to said magnet, wherein said actuator is operable between at least a first and second position, wherein said actuator moves said magnet to said first position when said actuator is in said first position and wherein said actuator moves said magnet to said second position when said actuator is in said second position.

14. The invention of claim 13 wherein said magnet is moveable along a linear path.

15. The invention of claim 14 wherein said magnet moves along a track between said first and second positions to said first support member.

16. An office furniture device comprising:

a first and second support member, said first support member having first and second fluid passageways formed within at least a portion thereof, wherein said first and second fluid passageways are connected with a third fluid passageway;

a first piston moveably disposed in said first fluid passageway, said first piston having a first and second end, wherein said second support member is coupled to said first end of said first piston;

a fluid supply disposed in said first fluid passageway and communicating with said second end of said first piston, wherein said fluid supply flows through said third fluid passageway between said first and second fluid passageways;

a second piston moveably disposed in said second fluid passageway and having a first end and a second end, wherein said second end communicates with said fluid supply;

a force applying element biasing said first end of said second piston; and a fluid flow controller controlling a flow of said fluid supply at a location between said first and second pistons, wherein said controller is operable between at least an open and closed position, wherein said fluid supply is allowed to flow between said first and second pistons when said controller is in the open position and wherein said fluid supply is prevented from flowing between said first and second pistons when said controller is in the closed position.

17. An office furniture device comprising:

a first and second support member, said first support member having a fluid passageway formed within at least a portion thereof, wherein said second support member comprises a chair component and wherein said second support member is slideably connected to said first support members;

a first piston moveably disposed in said fluid passageway, said first piston having a first and second end, wherein said second support member is coupled to said first end of said first piston;

a fluid supply disposed in said fluid passageway and communicating with said second end of said first piston;

a second piston having a first end and a second end, wherein said second end communicates with said fluid supply;

a force applying element biasing said first end of said second piston; and a fluid flow controller controlling a flow of said fluid supply at a location between said first and second pistons, wherein said controller is operable between at least an open and closed position, wherein said fluid supply is allowed to flow between said first and second pistons when said controller is in the open position and wherein said fluid supply is prevented from flowing between said first and second pistons when said controller is in the closed position.

18. A chair comprising:

a first and second support member, said first support member having a fluid passageway formed within at least a portion thereof, wherein said second support member comprises an armrest member;

a first piston moveably disposed in said fluid passageway, said first piston having a first and second end, wherein said second support member is coupled to said first end of said first piston;

a fluid supply disposed in said fluid passageway and communicating with said second end of said first piston;

a second piston having a first end and a second end, wherein said second end communicates with said fluid supply;

a force applying element biasing said first end of said second piston; and a fluid flow controller controlling a flow of said fluid supply at a location between said first and second pistons, wherein said controller is operable between at least an open and closed position, wherein said fluid supply is allowed to flow between said first and second pistons when said controller is in the open position and wherein said fluid supply is prevented from flowing between said first and second pistons when said controller is in the closed position.

19. An office furniture device comprising:

a first and second support member, said first support member having a fluid passageway formed within at least a portion thereof;

a first piston moveably disposed in said fluid passageway, said first piston having a first and second end, wherein said second support member is coupled to said first end of said first piston;

a fluid supply disposed in said fluid passageway and communicating with said second end of said first piston;

a second piston having a first end and a second end, wherein said second end communicates with said fluid supply, wherein said second piston is slideably disposed in said fluid passageway, and wherein said fluid supply is disposed in said fluid passageway between said first and second pistons;

a force applying element biasing said first end of said second piston; and a fluid flow controller controlling a flow of said fluid supply at a location between said first and second pistons, wherein said controller is operable between at least an open and closed position, wherein said fluid supply is allowed to flow between said first and second pistons when said controller is in the open position and wherein said fluid supply is prevented from flowing between said first and second pistons when said controller is in the closed position.

20. An office furniture device comprising:

a support member having a first and second fluid passageway formed within at least a portion thereof;

a first piston slideably disposed in said first fluid passageway, said first piston having a first and second end;

a second piston slideably disposed in said second fluid passageway, said second piston having a first end and a second end;

a fluid supply flowing between said first and second fluid passageways and communicating with said second ends of said first and second pistons, said fluid supply moving one of said first and second pistons in response to the movement of the other of said first and second pistons;

a fluid flow controller controlling a flow of said fluid supply between said first and second pistons.

21. The invention of claim 20 wherein said first and second fluid passageways are parallel.

22. The invention of claim 20 wherein said fluid is a magneto-Rheological fluid.

23. The invention of claim 21 wherein said controller comprises a magnet moveable between at least a first and second position corresponding to said open and closed positions respectively, wherein said magnet applies a magnetic field to said fluid supply when in said first position.

24. The invention of claim 23 further comprising an actuator connected to said magnet, wherein said actuator is operable between at least a first and second position, wherein said actuator moves said magnet to said first position when said actuator is in said first position and wherein said actuator moves said magnet to said second position when said actuator is in said second position.

25. The invention of claim 23 wherein said magnet is moveably disposed in said support member.

26. The invention of claim 20 wherein said fluid is a hydraulic fluid.

27. The invention of claim 26 wherein said controller comprises a valve.

28. The invention of claim 20 further comprising a chair component connected to and moveable with one of said support member and said first piston.

29. The invention of claim 28 wherein said support member comprises a first support member and further comprising a second support member slideably connected to said first support member, and wherein at least one of said chair component and said first piston is connected to said second support member.

30. The invention of claim 20 further comprising a mechanical spring biasing said second piston.

31. The invention of claim 20 wherein said support member comprises a one-piece member having an interior surface defining said first and second fluid passageways.

32. A method for operating an office furniture device comprising:

providing a first and second support member, said first support member having a fluid passageway formed within at least a portion thereof;

providing a first piston moveably disposed in said fluid passageway, said first piston having a first and second end, wherein said second support member is coupled to said first end of said first piston;

providing a fluid supply in said fluid passageway, wherein said fluid supply communicates with said second end of said first piston;

providing a second piston having a first end and a second end, wherein said second end communicates with said fluid supply;

stopping a flow of said fluid supply at a location between said first and second pistons with a fluid flow controller;

operating said controller in an open position and thereby allowing said fluid supply to flow past said location between said first and second pistons; and applying a force to said first end of said second piston, thereby flowing said fluid supply past said location between said first and second pistons and thereby moving said first piston with said fluid supply.

33. The invention of claim 32 wherein said stopping said flow further comprising operating said controller in a closed position.

34. The invention of claim 32 further comprising applying a force to said first end of said first piston.

35. The invention of claim 32 wherein said applying a force to said first end of said second piston comprises biasing said first end of said second piston with a spring.

36. The invention of claim 32 wherein said fluid supply comprises a magneto-rheological fluid.

37. The invention of claim 36 wherein said operating said controller in said open position comprises moving a magnet adjacent said fluid supply and thereby applying a magnetic field to said fluid supply.

38. The invention of claim 37 wherein said moving said magnet comprises moving an actuator connected to said magnet between at least a first and second position.

39. The invention of claim 32 wherein said fluid supply comprises a hydraulic fluid, and wherein said operating said controller in said open position comprises opening a valve to an open position.

40. The invention of claim 32 wherein said fluid passageway is a first fluid passageway and wherein said first support member further comprises a second fluid passageway, wherein said second piston is moveably disposed in said second fluid passageway.

41. The invention of claim 32 wherein said second support member comprises a chair component.

42. The invention of claim 41 wherein said chair component comprises an armrest member.

43. The invention of claim 42 wherein said fluid passageway is extruded in said first support member.

44. An office furniture device comprising:

a support member having a fluid passageway formed within at least a portion thereof;

a piston moveably disposed in said fluid passageway and having a first and second end;

a magneto-rheological fluid disposed in said fluid passageway and communicating with said second end of said piston;

a magnet moveable between at least a first and second position, wherein said magnet applies a magnetic field to said magneto-rheological fluid when in said first position; and an actuator connected to said magnet, wherein said actuator is operable between at least a first and second position, wherein said actuator moves said magnet to said first position when said actuator is in said first position and wherein said actuator moves said magnet to said second position when said actuator is in said second position.

45. The invention of claim 44 wherein said magnet is moveably disposed in said support member.

46. The invention of claim 44 wherein said magnet is moveable along a linear path.

47. The invention of claim 44 further comprising a shuttle member supporting said magnet, wherein said actuator is connected to said shuffle member, and wherein said shuttle moves along a track.

48. The invention of claim 47 wherein said magnet is disposed in said shuttle.

49. The invention of claim 44 wherein said actuator comprises a spring biasing said magnet between said first and second positions.

50. The invention of claim 49 wherein said actuator further comprises a push rod connected to said magnet.

51. The invention of claim 44 wherein said magnet is rare earth magnet.

52. The invention of claim 44 wherein said support member forms part of an armrest on a chair.

* * * * *